US011376879B2

(12) United States Patent
Fisher

(10) Patent No.: US 11,376,879 B2
(45) Date of Patent: Jul. 5, 2022

(54) WATER-DISPERSIBLE DIRECT THERMAL OR INKJET PRINTABLE MEDIA

(71) Applicant: Appvion Operations, Inc., Appleton, WI (US)

(72) Inventor: Mark R. Fisher, Appleton, WI (US)

(73) Assignee: Appvion, LLC, Appleton, WI (US)

( * ) Notice: Subject to any disclaimer, the term of this patent is extended or adjusted under 35 U.S.C. 154(b) by 0 days.

(21) Appl. No.: 17/100,349

(22) Filed: Nov. 20, 2020

(65) Prior Publication Data

US 2021/0155027 A1 May 27, 2021

Related U.S. Application Data

(60) Provisional application No. 62/939,418, filed on Nov. 22, 2019.

(51) Int. Cl.
*B41M 5/50* (2006.01)
*B41M 5/52* (2006.01)
(Continued)

(52) U.S. Cl.
CPC ..... *B41M 5/52* (2013.01); *B41M 5/41* (2013.01); *B41M 5/44* (2013.01); *B41M 5/502* (2013.01); *B41M 5/506* (2013.01); *B41M 5/508* (2013.01)

(58) Field of Classification Search
CPC ..... B41M 5/52; B41M 5/502; B41M 5/506; B41M 5/508
(Continued)

(56) References Cited

U.S. PATENT DOCUMENTS 5,215,812 A 6/1993 Kano et al.
5,342,649 A 8/1994 Sarokin
(Continued)

FOREIGN PATENT DOCUMENTS

EP 1565614 B1 7/2007
EP 3103649 A1 * 12/2016 ..... B41M 5/426
(Continued)

OTHER PUBLICATIONS

Aquasol™ Water Soluble Paper and Tape brochure, 2019 or earlier, 4 pages.
(Continued)

*Primary Examiner* — Betelhem Shewareged
(74) *Attorney, Agent, or Firm* — Stephen C. Jensen; Davis & Kuelthau, S.C.

(57) ABSTRACT

Dispersible record materials or media include a water-soluble or water-dispersible paper substrate, a printable layer carried by the substrate, and a base coat between the substrate and the printable layer. The printable layer may be a thermally responsive layer, e.g. containing a leuco dye and an acidic color developer, or an inkjet receptive layer. The binder material used in the base coat, and the base coat itself, are non-water-soluble, but nevertheless tailored in such a way that the record material as a whole is water-dispersible, i.e., it breaks apart under the influence of water with minimal agitation. The binder material of the base coat is preferably a non-resinous binder, a particulate binder, and/or a binder derived from a dispersion, such as latex. Use of such a binder material in a carefully selected concentration, with other elements, provides a base coat that allows for high quality images to be thermally printed at high print speeds on the thermally responsive layer.

12 Claims, 1 Drawing Sheet

(51) Int. Cl.
*B41M 5/41* (2006.01)
*B41M 5/44* (2006.01)

(58) Field of Classification Search
USPC ..... 428/32.21
See application file for complete search history.

(56) References Cited

U.S. PATENT DOCUMENTS

| | | | |
|---|---|---|---|
| 6,015,771 | A | 1/2000 | Fisher et al. |
| 6,429,341 | B2 | 8/2002 | Mathiaparanam |
| 6,777,075 | B2 | 8/2004 | Concannon et al. |
| 7,361,399 | B2 | 4/2008 | Song et al. |
| 7,476,448 | B2 | 1/2009 | Natsui et al. |
| 7,485,402 | B2 | 2/2009 | Arai et al. |
| 7,749,580 | B2 | 7/2010 | Song et al. |
| 8,287,961 | B2 | 10/2012 | Hill et al. |
| 8,334,047 | B2 | 12/2012 | Kelly et al. |
| 8,480,225 | B2 | 7/2013 | Romano, Jr. et al. |
| 8,536,087 | B2 | 9/2013 | Harrison et al. |
| 8,709,546 | B2 | 4/2014 | Zhou et al. |
| 8,795,796 | B2 | 8/2014 | Koenig |
| 8,802,591 | B2 | 8/2014 | Hill et al. |
| 8,877,678 | B2 | 11/2014 | Koyama et al. |
| 9,418,576 | B2 | 8/2016 | Franklin |
| 9,534,156 | B2 | 1/2017 | Fisher |
| 9,656,498 | B2 | 5/2017 | Yamane et al. |
| 9,767,714 | B2 | 9/2017 | Franklin |
| 9,789,721 | B2 | 10/2017 | Takano et al. |
| 9,962,980 | B2 | 5/2018 | Morie et al. |
| 10,184,062 | B2 | 1/2019 | Einsla et al. |
| 2004/0096598 | A1 | 5/2004 | Kasamatsu et al. |
| 2004/0096599 | A1* | 5/2004 | Kobayashi ..... B41M 5/52 428/32.1 |
| 2005/0096221 | A1 | 5/2005 | Fisher et al. |
| 2009/0086032 | A1 | 4/2009 | Li |
| 2009/0155613 | A1 | 6/2009 | Kalishek |
| 2009/0286032 | A1 | 11/2009 | Franklin |
| 2011/0285122 | A1 | 11/2011 | Hill et al. |
| 2017/0365195 | A1 | 12/2017 | Franklin |
| 2019/0270328 | A1 | 9/2019 | Kishimoto et al. |
| 2019/0291493 | A1 | 9/2019 | Fisher et al. |
| 2021/0155027 | A1* | 5/2021 | Fisher ..... B41M 5/41 |

FOREIGN PATENT DOCUMENTS

| | | | |
|---|---|---|---|
| JP | 2578069 | B2 | 2/1997 |
| JP | 4721432 | B2 | 7/2011 |
| JP | 2012061612 | A | 3/2012 |
| JP | 2016182799 | A | 10/2016 |
| JP | 6586915 | B2 | 10/2019 |
| WO | WO 2018/139183 | | 8/2018 |
| WO | WO 2019/049619 | | 3/2019 |
| WO | WO 2019/130968 | | 7/2019 |

OTHER PUBLICATIONS

Avery Dennison™ FreshMarx™ flyer, 2018, 1 page.
FreshMarx™ flyer, "Trust Your Food Safety", 2010, 1 page.
Neenah™ Dispersa™ For Tag and Boardstock brochure, Jul. 2020, 1 page.
Neenah™ Dispersa™ For Labels 7630P0 brochure, Oct. 2020, 1 page.
Smartsolve™ Product Data Sheet, Jul. 21, 2015, 2 pages.

* cited by examiner

WATER-DISPERSIBLE DIRECT THERMAL OR INKJET PRINTABLE MEDIA

CROSS-REFERENCE TO RELATED APPLICATIONS

This application claims priority under 35 U.S.C. § 119 (e) to provisional patent application U.S. Ser. No. 62/939,418, "Water-Dispersible Direct Thermal Media With Excellent Thermal Image Quality", filed Nov. 22, 2019, the contents of which are incorporated herein by reference.

FIELD OF THE INVENTION

The present invention relates to direct thermal record media, with particular application to such media that are water dispersible. The invention also relates to inkjet printable media that are water dispersible. The invention also pertains to related methods, systems, and articles.

BACKGROUND

Numerous types of direct thermal record media, sometimes referred to as thermally-responsive record materials, direct thermal recording media, or direct thermal media, are known. See, for example, U.S. Pat. No. 3,539,375 (Baum), U.S. Pat. No. 3,674,535 (Blose et al.), U.S. Pat. No. 3,746,675 (Blose et al.), U.S. Pat. No. 4,151,748 (Baum), U.S. Pat. No. 4,181,771 (Hanson et al), U.S. Pat. No. 4,246,318 (Baum), and U.S. Pat. No. 4,470,057 (Glanz). In these cases, basic colorless or lightly colored chromogenic material, such as a leuco dye, and an acidic color developer material are contained in a coating on a substrate which, when heated to a suitable temperature, melts or softens to permit the materials to react, thereby producing a colored mark or image at the place where the heat was applied. Thermally-responsive record materials have a characteristic thermal response, producing a colored image of sufficient intensity upon selective thermal exposure.

Some direct thermal record media have been described or proposed in which the substrate or base material of the product is a water-dissolvable or water-dispersible paper material, such that the resulting direct thermal record media as a whole can be easily dissolved or dispersed by the end user. See e.g. U.S. Pat. No. 7,476,448 (Natsui et al.). Some such products have been sold, but have suffered from poor quality image formation. That is, when such products are fed through a conventional direct thermal printer to print an image at a normal print speed, such as 6 inches per second (ips), the resulting image quality is typically so poor that a bar code image cannot be reliably scanned and read by standard bar code readers. The poor image quality is believed to be due to the outer surface of the product being too rough or non-smooth, which may result from puckering or swelling of the water-dispersible base stock during manufacturing when a first layer is coated in an aqueous solution onto the surface of the base stock.

SUMMARY OF THE INVENTION

Direct thermal record media that are designed to be easily dissolvable or dispersible in water have many useful applications, such as removable labels on reusable containers or bins, or as security substrates that can be easily and completely destroyed without the need for shredding. But unless the image quality on such media is good enough to be reliably scanned and read by a standard bar code reader, the number of potential useful applications will remain limited.

A need therefore exists for alternative dissolvable or dispersible direct thermal record media, especially such media that can provide reliably machine-readable bar code images when used with standard thermal printers operating at reasonable print speeds. Such alternative media or materials are preferably suitable for use in diverse applications such as labeling, facsimile, point of sale (POS) printing, printing of tags, and pressure-sensitive labels. The alternative media also preferably produce high quality images (including high quality bar code images) when used with thermal printers whose print speed is at least 6, or 8, or even 10 inches per second (ips).

A similar need also exists for alternative dissolvable or dispersible inkjet printable record media.

We have developed a new family of water-dispersible record materials or media that can be tailored to satisfy one, some, or all of these needs. The disclosed alternative record media generally include a paper substrate that may be water-soluble or water-dispersible, a printable layer, and a base coat between the substrate and the printable layer. The printable layer may be a thermally responsive layer, e.g. containing a leuco dye and an acidic color developer, or an inkjet receptive layer. In some cases the water-dispersible record material may have two distinct printable layers, such as a thermally responsive layer capable of being imaged by a direct thermal printer, and an inkjet receptive layer.

We have discovered advantages to using a non-water-soluble binder material together with other components in the base coat, and have further found that such a binder material, when used in a judicious amount, allows the resulting record media to be water-dispersible, i.e., it breaks apart under the influence of water with minimal agitation. The binder material of the base coat, and the base coat itself, are thus non-water-soluble, but nevertheless tailored such that the record material as a whole is water-dispersible. The binder material of the base coat is preferably a non-resinous binder, a particulate binder, and/or a binder derived from a dispersion, such as latex. Use of such a binder material in a carefully selected concentration, with other elements, provides a base coat that allows for high quality images to be thermally printed at high print speeds on the thermally responsive layer. Characteristics of the base coat that help promote such performance are its bulk or thickness, its relatively low thermal conductivity, and its relatively weak internal cohesiveness.

We therefore disclose herein, among other things, record materials or media that include a substrate, a thermally responsive layer carried by the substrate, and a base coat between the substrate and the thermally responsive layer. The substrate may be or include a water-soluble or water-dispersible paper. The base coat may include a binder that is non-water-soluble, non-resinous, particulate, derived from a dispersion, and/or latex.

The latex may be present in the base coat in a concentration from 10-30 wt %, or from 15-20 wt %. The base coat may also include a hollow sphere pigment (HSP), which may be present in the base coat in a concentration from 20-50 wt %, or from 30-50 wt %. The base coat may further include a second pigment selected from the group of clay particles, precipitated calcium carbonate, and fumed silica, and the second pigment may be present in the base coat in a concentration less than 80 wt %, or in a range from 10-50 wt %.

In cases where the substrate contains pulp, a purified pulp containing at least 88 wt % of α-cellulose, or containing less than 12 wt % of hemi-cellulose, may account for less than 15 wt % of all the pulp in the substrate. Alternatively, such purified pulp may instead account for 15-95 wt % of all the pulp in the substrate.

We also disclose record media that include a substrate, a printable layer carried by the substrate, and a base coat between the substrate and the printable layer, where the substrate includes water-soluble paper or water-dispersible paper, and the base coat includes a non-water-soluble binder. Such record material is water dispersible even though the base coat is non-water-soluble. The printable layer may be a thermally responsive layer, or an inkjet receptive layer. A second printable layer may also be included, such as where a first printable layer is thermally responsive, and a second printable layer is inkjet receptive.

We also disclose numerous related methods, systems, and articles.

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

The inventive articles, systems, and methods are described in further detail with reference to the accompanying drawing, of which.

In the figures, like reference numerals designate like elements.

DETAILED DESCRIPTION

Figure 1:
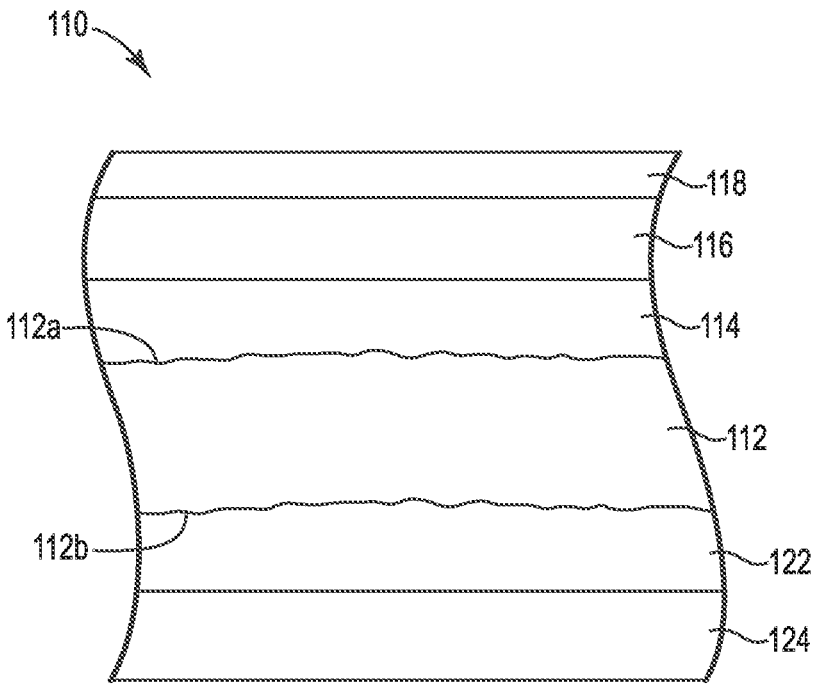
FIG. 1 is a schematic cross-sectional view of a water-dispersible record medium as disclosed herein.

Aspects of the invention include new types of direct thermal record material/media with new combinations of features and capabilities, and methods of making the same. As a direct thermal record medium, the product is adapted to change color in response to locally applied heat, such as when feeding the product through a direct thermal printer, so as to produce images of bar codes, alphanumeric characters, graphics, or combinations thereof. The inventive product is preferably adapted to be water-dispersible, i.e., adapted to disintegrate or break apart (disperse) when exposed to water, with minimal agitation. This is so despite the fact that the product incorporates a base coat that is non-water-soluble, and whose binder is non-water-soluble. Stated differently, the binder, and the base coat as a whole, does not dissolve in water.

Some water-dispersible direct thermal record materials are already known, but they generally suffer from poor quality image formation. That is, when a known product is processed by a direct thermal printer at a normal print speed (e.g. 6 inches per second (ips)) to print an image, the resulting image quality is generally poor. The image quality is so poor that bar code images, which require a high image quality to be reliably detected by machines, are of little to no utility. The poor image quality of the known product is believed to be due at least in part to the outer surface of the product being too rough or non-smooth. The rough surface is the result of component characteristics and the manufacturing process, wherein a water-dispersible base stock (water-dispersible paper) swells and roughens when the direct thermal layer is coated in an aqueous solution onto the base stock.

Therefore, an additional feature of at least some embodiments of the inventive record material, which distinguishes it over existing products, is the ability to produce high quality thermal images at normal print speeds, and even at high print speeds (8-10 ips), to enable machine readable bar code images to be formed in a water-dispersible direct thermal record material.

To obtain this high speed direct thermal print characteristic, we employ a carefully designed base coat between the base stock (substrate) and the direct thermal layer (or other printable layer). Reference in this regard is made to the water-dispersible record material 110 of FIG. 1. The record material 110 may be made by coating various layers onto a water-dispersible, or water soluble, base stock or carrier 112. The base stock 112 has a physical strength and thickness sufficient to allow it to be manipulated and handled in a coating machine without excessive tearing or breaking. The base stock 112 may thus be in the form of a web with two opposed major surfaces 112*a*, 112*b*. These surfaces are shown as being uneven or rough, which is exacerbated when the surfaces are wetted. Applied directly to one of these surfaces 112*a* is a base coat 114. Then atop the base coat 114 is applied a printable layer 116 such as a direct thermal layer. An optional top coat 118 may be applied to the printable layer 116.

On the other side of the base stock 112, an optional adhesive layer 122 such as a pressure-sensitive adhesive (PSA) or other adhesive material may be applied to the major surface 112*b*. The adhesive may be releasably supported or carried by an optional release liner 124. In the case of a label product, a user may remove the release liner 124 after forming a thermal image in the direct thermal layer 116, and affix the label so printed to a container or other suitable workpiece with the adhesive layer 122. After use, the label may be completely removed from the container by applying water with minimal or gentle agitation, causing the label to break apart to restore the container surface to its original state.

In exemplary embodiments, the base stock 112 may be or comprise a water-dispersible paper. Depending on its thickness and composition, the paper of the base stock 112 may be thin and flexible similar to ordinary office paper, or thicker and stiffer, as with cardstock or even boardstock. We use the term "paper" to encompass all such possibilities. The base stock 112 may for example have a thickness in a range from 2.5 mils to 20 mils.

A suitable paper for use as the base stock 112 is Neenah Dispersa™ dispersible paper available from Neenah, Inc., Alpharetta, Ga. Pulp of which the water-dispersible paper is made need not contain large amounts of so-called purified pulp, which contains at least 88 wt % of α-cellulose, or which contains less than 12 wt % of hemi-cellulose. Such purified pulp may for example account for less than 15 wt % of all the pulp in the substrate. There are several product offerings under the Neenah™ Dispersa™ brand, including product code 7630P0 (3.0-3.4 mil thickness, said to be for labels), product code 7741P0 (14 mil thickness, said to be for tag and boardstock), and product code 7742P0 (17 mil thickness, said to be for tag and boardstock).

Other water-dispersible papers suitable for use as the base stock 112 are also available. Aquasol Corporation of North Tonawanda, N.Y. sells a 3 mil thick water-dispersible flexible paper under product code ASW-35/S. SmartSolve Industries (part of CMC Group, Bowling Green, Ohio) sells a number of water-dispersible paper products, such as a 3 mil thick water-dispersible flexible paper under product code IT117970.

Some of the commercially available water-dispersible papers mentioned above are described in their respective manufacturers' marketing literature as "water-soluble".

In some embodiments, the water-dispersible paper of the base stock 112 may contain increased amounts of the purified pulp as disclosed in U.S. Pat. No. 8,877,678 (Koyama et al.). The purified pulp may for example account for 15-95 wt % of all the pulp in the substrate.

A base coat 114 is applied directly to one of the major surfaces 112*a* of the base stock 112. The base coat is specially tailored to provide a balanced combination of features. These include: having a sufficient bulk or thickness to be able to smooth over undulations or roughness of the major surface 112*a* of the base stock; having a sufficient air content to provide good thermal isolation (low thermal conductivity); and having an internal cohesiveness that is strong enough to remain intact during normal handling of the product but weak enough to break apart (disperse) when exposed to water after the underlying base stock 112 has dissolved, or begun to dissolve, or has dispersed, or begun to disperse.

We have discovered advantages to using a non-water-soluble binder material together with other components in the base coat, and have further found that such a binder material, when used in a judicious amount, allows the resulting record media to be water-dispersible, i.e., it breaks apart under the influence of water with minimal agitation. The binder material of the base coat, and the base coat itself, are thus non-water-soluble, but nevertheless tailored such that the record material as a whole is water-dispersible. The binder material of the base coat is preferably a non-resinous binder, a particulate binder, and/or a binder derived from a dispersion, such as latex. Use of such a binder material in a carefully selected concentration, with other elements, provides a base coat that allows for high quality images to be thermally printed on the thermally responsive layer at high print speeds.

A suitably tailored base coat 114, applied (directly) to an outer surface of the base stock 112, can substantially improve the imaging characteristics of the product, even though applying a water-based coating to the base stock increases the surface roughness. The base coat 114 is preferably neither too thin nor too thick. An insufficient coat weight produces a base coat that does not adequately insulate the printable layer 116 from the base stock, and that simply conforms to the undulating profile of the base stock. Increasing the coat weight of the base coat 114 has practical limitations because more water can cause more instability and roughening of the sheet during the coating procedure. Also, a base coat 114 that is too thick can make the internal cohesiveness of the layer too strong, thwarting the ability of the layer 114 (and the overall product 110) to break apart and disperse quickly when exposed to water. Preferably, the base coat 114 may have a thickness of at least 2 micrometers, and a coat weight in a range from 1 to 5 lbs/3300 $ft^2$ (1.5 to 7.5 $g/m^2$), but other coat weights and thicknesses may also be used if desired.

In order to increase bulk as well as air content of the base coat 114, we have found it useful to incorporate a hollow sphere pigment (HSP), such as Ropaque™ pigment from Dow Chemical, into the base coat. The hollow polymeric particles of the HSP can improve the bulk (thickness) of the base coat to smooth over effects of the roughening of the surface of the base stock 112. A benefit of HSP is that, if the product is calendared during the manufacturing process (after the base coat has been applied to the base stock, and dried), the HSP particles can deform on the surface in contact with the calendar surface (under the pressure of the nip) to provide a smoother surface than can be made using conventional pigments. HSP particles typically have an average diameter of a few micrometers or less, e.g. in a range from 0.4 to 2 micrometer. HSP particles are not soluble in water.

Other pigments besides HSP, such as calcine clay or other clay particles, and/or other particles that have good bulk and water absorbing properties, such as precipitated calcium carbonate (PCC) or fumed silica, can also be used—and preferably are used—in the base coat 114, but do not typically by themselves provide the bulk needed to overcome the roughening of the base stock. Such other pigments are not, or may not be, soluble in water. A mixture of HSP and one or more other pigments in the base coat 114 can provide a good balance of improved coverage, smoothness, and sheet integrity, allowing for high-speed (and normal speed) direct thermal printing of machine readable bar codes.

Another significant design consideration, and aspect of the invention, is the binder material to be used in the base coat 114. Conventional wisdom would suggest that the binder material used in the base coat 114 of a water-dispersible record material 110 should be water-soluble. But we have found that water-soluble binder materials tend to increase the thermal conductivity, and reduce the thermal insulation characteristic, of the base coat. Reduced thermal insulation degrades image quality, since the print quality of a direct thermal image is enhanced by thermally isolating the direct thermal layer from the base stock as much as possible. In contrast, our preferred binder materials—which are not water soluble—provide a quick-drying solution, and if used at a carefully tuned concentration, provide improved thermal insulation properties over the water-soluble binders while not impeding the water-dispersible nature of the substrate. Preferred binder materials for the base coat 114 include those that are non-water-soluble, those that are non-resinous, those that are a particulate binder, and/or those that are derived from a dispersion. An exemplary such binder material is latex. Alternative or additional binder materials may include cooked starch, polyvinyl alcohol (PVA), and AQ™ polymers available from the Eastman Chemical Company.

Figure 2:
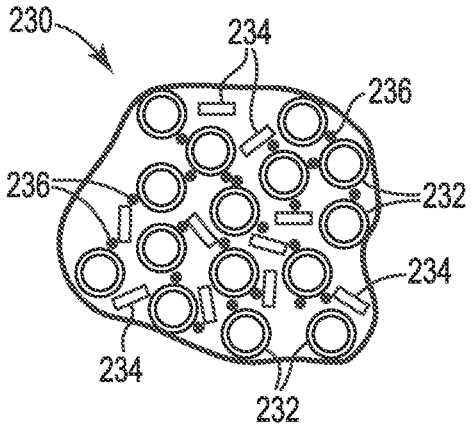
FIG. 2 is a schematic magnified view of a portion of a base coat used in the record medium of FIG. 1.

Carefully tuning this binder concentration balances the need to hold the pigment particles together in order to withstand normal handling of the material 110, with the need to provide an abundant number of air pockets and air gaps throughout the base coat 114 in order to increase thermal insulation, as well as with the need to provide a relatively weak internal cohesiveness of the base coat so that it readily breaks apart when the underlying base stock 112 begins to disintegrate or dissolve under the action of water. A schematic depiction of such a balanced or tuned state of affairs is shown in the magnified view of FIG. 2. There, a representative but small portion 230 of a base coat 114 is made up of HSP particles 232, particles 234 of a second pigment such as calcine clay, and binder particles 236 such as latex. The binder particles 236 are numerous enough to adequately hold the pigment particles together, but sparse enough to maintain an abundant number of air pockets and air gaps between the particles for adequate thermal insulation.

To provide the desired balance of characteristics, the latex or other suitable non-water-soluble binder is preferably present in the base coat 114 in a concentration from 10-30 wt %, or from 15-20 wt %. The HSP is preferably present in the base coat 114 in a concentration from 20-50 wt %, or from 30-50 wt %. The calcine clay or other suitable second pigment is preferably present in the base coat in a concentration less than 80 wt %, or in a range from 10-50 wt %.

Turning back to FIG. 1, the printable layer 116 is then coated atop the base coat 114. In some embodiments, the printable layer 116 is or comprises a direct thermal layer, which may be of otherwise conventional design. For example, the direct thermal layer may comprise a combination of a leuco dye, or other basic chromogenic material, and an acidic color developer material in a solid matrix or binder. See e.g. U.S. Pat. No. 3,539,375 (Baum); U.S. Pat. No. 3,674,535 (Blose et al.); U.S. Pat. No. 3,746,675 (Blose et al.); U.S. Pat. No. 4,151,748 (Baum); U.S. Pat. No. 4,181,771 (Hanson et al.); U.S. Pat. No. 4,246,318 (Baum); or U.S. Pat. No. 4,470,057 (Glanz). Other known types of direct thermal layers may instead be used, such as those disclosed in US 2019/0291493 (Fisher et al.), "Direct Thermal Recording Media Based on Selective Change of State". The direct thermal layers disclosed in U.S. Ser. No. 62/905,815, "Direct Thermal Recording Media with Perforated Particles", filed Sep. 25, 2019, containing perforated particles and other components in the direct thermal layer, can also be used.

In other embodiments, the dispersible record material 110 may be adapted not for direct thermal printing, but instead for other printing techniques, such as inkjet printing. In such cases the printable layer 116 may be or comprise an inkjet receptive layer of known design.

An optional protective top coat 118 can be applied to the printable layer 116 as shown in FIG. 1 to improve durability to handling such as scuff, and can be added to the product while retaining the product features of water dispersibility and high speed bar code (high image quality) thermal printing. The top coat 118 may be of conventional design, e.g., comprising binders such as modified or unmodified polyvinyl alcohols, acrylic binders, crosslinkers, lubricants, and fillers such as aluminum trihydrate and/or silicas.

The record material 110 can be used as a self-adhesive label by adding an otherwise conventional adhesive layer 122 and release liner 124 as shown. The pressure sensitive adhesive (PSA) or other adhesive used in the adhesive layer is preferably water-dispersible or water-dissolvable so that after use, the entire label can be easily washed away and completely removed from the workpiece to which it was attached by the user, e.g. after direct thermal printing.

EXAMPLES

Example 1: A record material as shown generally in FIG. 1, but without layers 118, 122, and 124, was made and tested. The base stock 112 used was the Neenah Dispersa™ dispersible paper, product code 7630P0, referenced above. A base coat 114 was then applied to the major surface 112*a* at a coat weight of 6 grams per square meter (gsm). The formulation of the base coat was as follows:

Water: 40.5 parts
Mineral Pigment 1A: 21.5 parts
HSP @ 19.5% solids in water: 26.3 parts
Latex @ 50% solids in water: 11.5 parts The Mineral Pigment 1A was Calcine Clay (Kaocal by Thiele Kaolin Company). The HSP used was Ropaque TH-2000AF by Dow Chemical, having an average diameter of nominally 1.6 micrometers. The Latex used was SBR latex (LIGOS KX4505 by Trinseo LLC.).

After drying, a printable layer 116 was applied to the exposed surface of the base coat. The printable layer was a direct thermal layer of conventional design, containing the combination of a leuco dye and an acidic color developer material in a matrix. The leuco dye used was ODB-2 (CAS no. 89331-94-2, chemical name spiro(isobenzofuran-1(3H), 9'-(9H)xanthen)-3-one, 6'-(ethyl(4-methylphenyl)amino)-3'-methyl-2'-(phenylamino)-), and the developer was TGSH (chemical name Bis(3-allyl-4-hydroxyphenyl)sulfone). The resulting dispersible direct thermal record media was imaged with a barcode pattern on a Zebra™ thermal printer, model 140-401-0004, at speeds of 6, 8, and 10 ips at factory default heat settings. The resulting bar code images were then tested for ANSI values as a measure of the quality of the images. The ANSI values were measured using a TrueRemote™ Webscan™ Barcode Verifier, model TC-843, operating at a wavelength of 650 nm. The tested ANSI values for the samples printed at each of the three print speeds were all above 1.5, i.e., reliable for machine barcode reading.

Example 1 was also tested for its response to liquid water. Upon directing a gentle stream of water at a printed sample, it was found to disintegrate and disperse promptly and completely.

Example 2: A record material similar in some respects to Example 1 was made, having only layers 112, 114, and 116 (see FIG. 1). The base stock 112 used was the water-dispersible paper product referenced above sold by SmartSolve Industries, product code IT117970. This base stock was 3 mils thick. A base coat 114 was then applied to the major surface 112*a* at a coat weight of 6 gsm, and allowed to dry. The formulation of the base coat was substantially as follows:

Water: 32.1 parts
Mineral Pigment 1A (see above): 24.5 parts
HSP @ 19.5% solids in water: 29.3 parts
Latex @ 50% solids in water: 12.8 parts A printable layer 116 was then applied to the exposed surface of the base coat. The printable layer had a coat weight of 3 gsm and was again a direct thermal layer of conventional design, containing ODB-2 and TGSH. The resulting dispersible direct thermal record media was imaged with a barcode pattern in the same manner as Example 1 (Zebra™ printer, default heat settings, print speeds of 6, 8, and 10 ips). The resulting bar code images were then tested for ANSI values in the same manner as Example 1. The tested ANSI values at each of the three print speeds were all above 1.5.

Example 2 was also tested for its response to liquid water. Upon directing a gentle stream of water at a printed sample, it was found to disintegrate and disperse promptly and completely.

Example 3: A record material similar in some respects to Examples 1 and 2 was made, having only layers 112, 114, and 116 (see FIG. 1). The base stock 112 used was the same water-dispersible paper product used in Example 2. A base coat 114 was then applied to the major surface 112*a* at a coat weight of 3 gsm, and allowed to dry. The formulation of the base coat was substantially as follows:

HSP @ 19.5% solids in water: 88.6 parts
Latex @ 50% solids in water: 8.3 parts
Precipitated calcium carbonate: 1.9 parts
Ground calcium carbonate: 1.2 parts A printable layer 116 was then applied to the exposed surface of the base coat. The printable layer had the same composition and coat weight as the printable layer of Example 2. The resulting dispersible direct thermal record media was imaged with a barcode pattern in the same manner as Examples 1 and 2 (Zebra™ printer, default heat settings, print speeds of 6, 8, and 10 ips). The resulting bar code images were then tested for ANSI values in the same manner as Examples 1 and 2. The tested ANSI values at each of the three print speeds were all above 1.5.

Example 3 was also tested for its response to liquid water. Upon directing a gentle stream of water at a printed sample, it was found to disintegrate and disperse promptly and completely.

Example 4: A record material similar in some respects to Examples 1-3 was made, except that a top coat layer 118 (see FIG. 1) was added atop the printable layer 116. The base stock 112 used was the same water-dispersible paper product used in Examples 2 and 3. A base coat 114 was then applied to the major surface 112*a* at a coat weight of 3 gsm, and allowed to dry. The formulation of the base coat was substantially as in Example 3.

A printable layer 116 was then applied to the exposed surface of the base coat. The printable layer had the same composition and coat weight as the printable layer of Examples 2 and 3.

A top coat layer 118 was then applied to the exposed surface of the printable layer. The top coat layer had a coat weight of 3 gsm, and its composition was tailored for inkjet receptivity.

Its formulation was substantially as follows:

Aluminum hydroxide @ 40% solids in water: 33.7 parts

Polyvinyl alcohol (PVA) @ 9.0% solids in water: 31.3 parts

Water: 10.9 parts

Crosslinker: 9.4 parts

Amorphous silica @ 30% solids in water: 7.8 parts

BASF Catiofast 159A: 4.7 parts

Printhead lubricant (Hildorin H-526): 2.1 parts

The top coat could thus also be considered a second (or another) printable layer, permitting inkjet printing onto its own surface while simultaneously allowing for direct thermal printing of images in the underlying printable layer 116.

The resulting dispersible record material was imaged (through layer 118 to layer 116) with a barcode pattern in the same manner as Examples 1-3 (Zebra™ printer, default heat settings, print speeds of 6, 8, and 10 ips). The resulting bar code images were tested for ANSI values in the same manner as Examples 1-3. The tested ANSI value at the slowest print speed (6 ips) was above 1.5, but the ANSI values at the faster print speeds (8 and 10 ips) were both below 1.5.

Example 4 was printed on its top coat using an HP Photosmart™ inkjet printer, model 7960. The printer's factory-set calibration page was the pattern or image that was printed and evaluated to assess the inkjet compatibility of the sample. The evaluation showed that the printed samples had acceptable image quality and showed no evidence of ink smudge or line bleed.

Example 4 was also tested for its response to liquid water. Upon directing a gentle stream of water at a printed sample, it was found to disintegrate and disperse completely and promptly, although not as rapidly as Examples 1-3.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

Unless otherwise indicated, all numbers expressing quantities, measured properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings herein. Not to limit the application of the doctrine of equivalents to the scope of the claims, each numerical parameter should at least be construed in light of the number of reported significant digits and by applying ordinary rounding techniques.

The use of relational terms such as "top", "bottom", "upper", "lower", "above", "below", and the like to describe various embodiments are merely used for convenience to facilitate the description of some embodiments herein. Notwithstanding the use of such terms, the present disclosure should not be interpreted as being limited to any particular orientation or relative position, but rather should be understood to encompass embodiments having any orientations and relative positions, in addition to those described above.

Various modifications and alterations of this invention will be apparent to those skilled in the art without departing from the spirit and scope of this invention, which is not limited to the illustrative embodiments set forth herein. The reader should assume that features of one disclosed embodiment can also be applied to all other disclosed embodiments unless otherwise indicated. All U.S. patents, patent application publications, and other patent and non-patent documents referred to herein are incorporated by reference, to the extent they do not contradict the foregoing disclosure.

The invention claimed is:

1. A record material, comprising:

a substrate that includes water-soluble paper or water-dispersible paper;

a thermally responsive layer carried by the substrate; and a base coat between the substrate and the thermally responsive layer;

wherein the base coat includes a non-water-soluble binder and a hollow sphere pigment (HSP), the HSP being present in the base coat in a concentration from 20-50 wt %.

2. The record material of claim 1, wherein the record material is water dispersible even though the base coat is non-water-soluble.

3. The record material of claim 1, wherein the non-water-soluble binder is non-resinous, or particulate, or derived from a dispersion.

4. The record material of claim 1, wherein the non-water-soluble binder includes latex.

5. The record material of claim 1, wherein the non-water-soluble binder is latex, and wherein the latex is present in the base coat in a concentration from 10-30 wt %.

6. The record material of claim 5, wherein the latex is present in the base coat in a concentration from 15-20 wt %.

7. The record material of claim 1, wherein the HSP is present in the base coat in a concentration from 30-50 wt %.

8. The record material of claim 1, wherein the base coat includes a second pigment selected from the group of clay particles, precipitated calcium carbonate, and fumed silica.

9. The record material of claim 8, wherein the second pigment is present in the base coat in a concentration less than 80 wt %.

10. The record material of claim 9, wherein second pigment is present in the base coat in a concentration from 10-50 wt %.

11. The record material of claim 1, wherein the substrate contains pulp, and wherein purified pulp containing at least 88 wt % of α-cellulose, or containing less than 12 wt % of hemi-cellulose, accounts for less than 15 wt % of all the pulp in the substrate.

12. The record material of claim 1, wherein the substrate contains pulp, and wherein purified pulp containing at least 88 wt % of α-cellulose, or containing less than 12 wt % of hemi-cellulose, accounts for 15-95 wt % of all the pulp in the substrate.

* * * * *